US009743715B1

(12) United States Patent
Brekke-Jones

(10) Patent No.: US 9,743,715 B1
(45) Date of Patent: Aug. 29, 2017

(54) LACE ALTERNATIVE SHOE SECUREMENT DEVICE

(71) Applicant: Nancy Brekke-Jones, Rhinelander, WI (US)

(72) Inventor: Nancy Brekke-Jones, Rhinelander, WI (US)

( * ) Notice: Subject to any disclaimer, the term of this patent is extended or adjusted under 35 U.S.C. 154(b) by 12 days.

(21) Appl. No.: 14/720,431

(22) Filed: May 22, 2015

Related U.S. Application Data

(60) Provisional application No. 62/002,530, filed on May 23, 2014.

(51) Int. Cl.

| | |
|---|---|
| ***A43C 11/00*** | (2006.01) |
| ***A43C 19/00*** | (2006.01) |
| ***A43C 11/02*** | (2006.01) |
| ***A43C 11/06*** | (2006.01) |
| ***A43C 11/24*** | (2006.01) |
| ***F21V 33/00*** | (2006.01) |
| *F21Y 101/02* | (2006.01) |

(52) U.S. Cl.
CPC ..... *A43C 19/00* (2013.01); *A43C 11/02* (2013.01); *A43C 11/06* (2013.01); *A43C 11/24* (2013.01); *F21V 33/0008* (2013.01); *F21Y 2101/02* (2013.01); *Y10T 24/2183* (2015.01); *Y10T 24/2708* (2015.01)

(58) Field of Classification Search
CPC ..... A43C 11/1493; A43C 11/00; A43C 11/22; Y10T 24/2708; Y10T 24/27; Y10T 24/2183; A43B 11/00; A43B 1/0081; A44B 18/00; F21Y 2101/02; F21V 33/0008
See application file for complete search history.

(56) References Cited

U.S. PATENT DOCUMENTS

| | | | | |
|---|---|---|---|---|
| 4,907,352 | A | 3/1990 | Ginsberg | |
| 5,027,482 | A | 7/1991 | Torppey | |
| 5,148,614 | A * | 9/1992 | Kelly | A43B 11/00 36/1 |
| 5,203,053 | A | 4/1993 | Rudd | |
| 5,526,585 | A * | 6/1996 | Brown | A43C 11/22 36/50.1 |
| 5,572,774 | A | 11/1996 | Duren | |
| 5,894,640 | A | 4/1999 | Dewey | |
| 5,934,784 | A * | 8/1999 | Dion | A43B 1/0036 362/103 |
| 2016/0015131 | A1* | 1/2016 | Rivas | A43C 11/22 12/142 LC |

* cited by examiner

*Primary Examiner* — Robert J Sandy
*Assistant Examiner* — Michael Lee
(74) *Attorney, Agent, or Firm* — Joseph L. Powell; Walker & Jocke Co., LPA

(57) ABSTRACT

An exemplary embodiment provides for a conversion kit for a shoe, changing the configuration from lace to strap configuration, wherein the kit contains a strap with hook and loop material attached to the shoe through a shoe lace aperture, a loop piece attached to the shoe through a shoe lace aperture where the strap passes through the loop piece and is pulled taught to secure the shoe to the wearers' foot.

15 Claims, 5 Drawing Sheets

LACE ALTERNATIVE SHOE SECUREMENT DEVICE

CROSS REFERENCE TO RELATED APPLICATIONS

This application claims benefit of U.S. Provisional Application Ser. No. 62/002,530 filed May 23, 2014, the disclosure of which is incorporated herein by reference in its entirety.

TECHNICAL FIELD

Exemplary embodiments pertain to shoe construction. An exemplary embodiment provides a conversion kit for changing a shoe between lace and strap holding configurations.

BACKGROUND

Shoes are a common piece of apparel for humans. Shoes are important for protecting feet from injury. Different shoes provide different capabilities for different use conditions. Shoes are also often stylized for aesthetic purposes.

Shoes may benefit from improvements.

SUMMARY

An exemplary embodiment provides an apparatus that can be used to change a shoe between a laced configuration and a strap configuration. An exemplary embodiment provides a shoe holding attachment device that can be used as a shoe lace alternative on shoes having existing shoelace apertures. The exemplary apparatus enables changing a shoe between laced and strap holding configurations and provides other features and benefits described therein.

DETAILED DESCRIPTION

Figure 1:
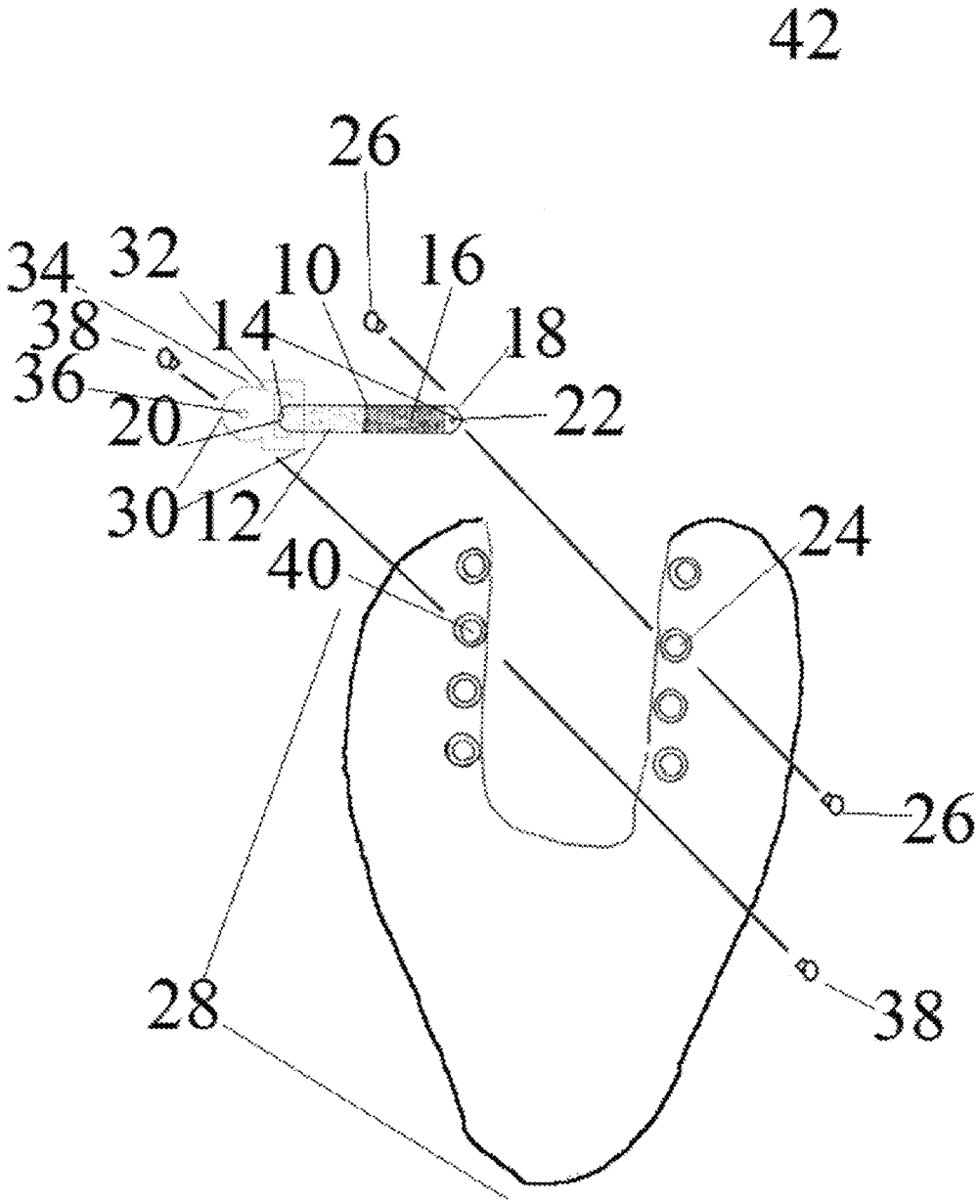
FIG. 1 shows an exemplary view of an embodiment of the strap, loop piece, fastener and further fastener in operative connection with a shoe.
Figure 2:
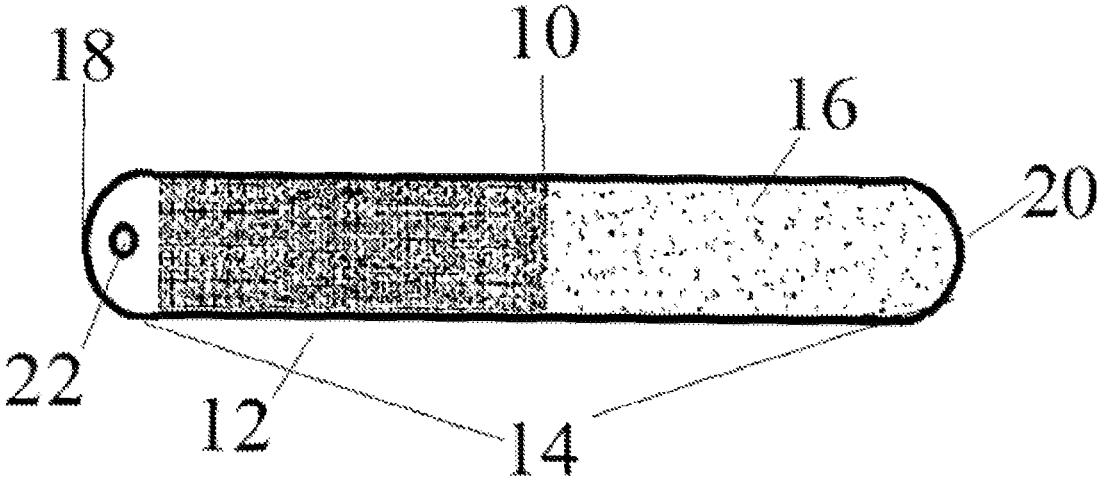
FIG. 2 shows an exemplary view of an embodiment of the strap.
Figure 3:
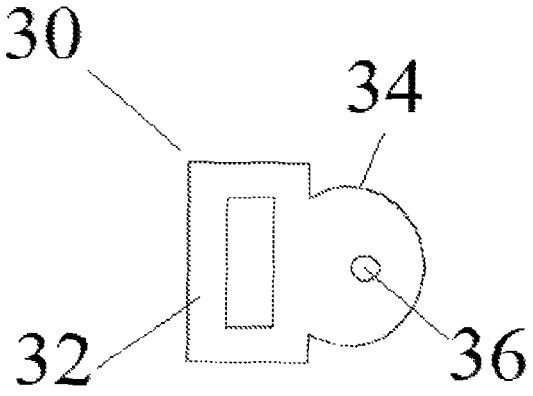
FIG. 3 shows an exemplary view of an embodiment of the loop piece.
Figure 4:
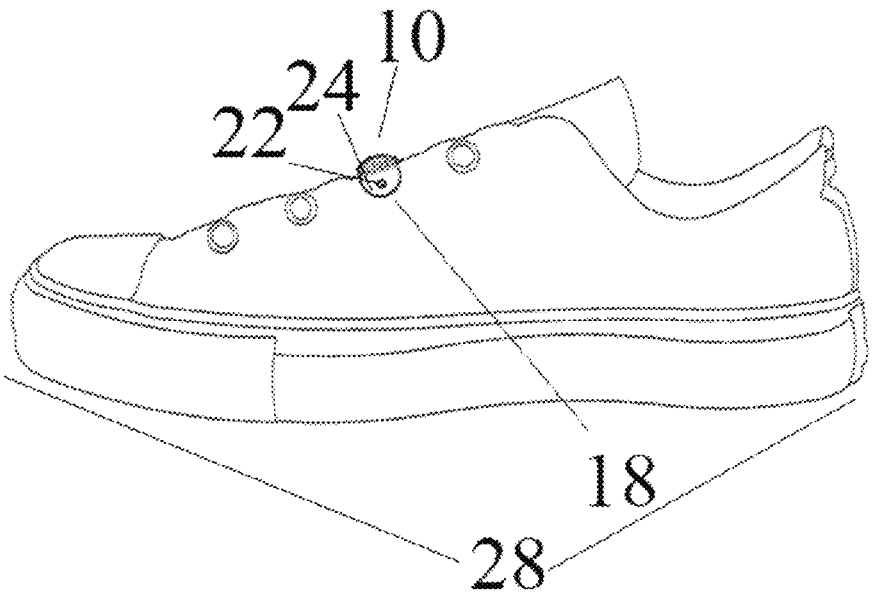
FIG. 4 shows an exemplary view of a shoe with the strap attached.
Figure 5:
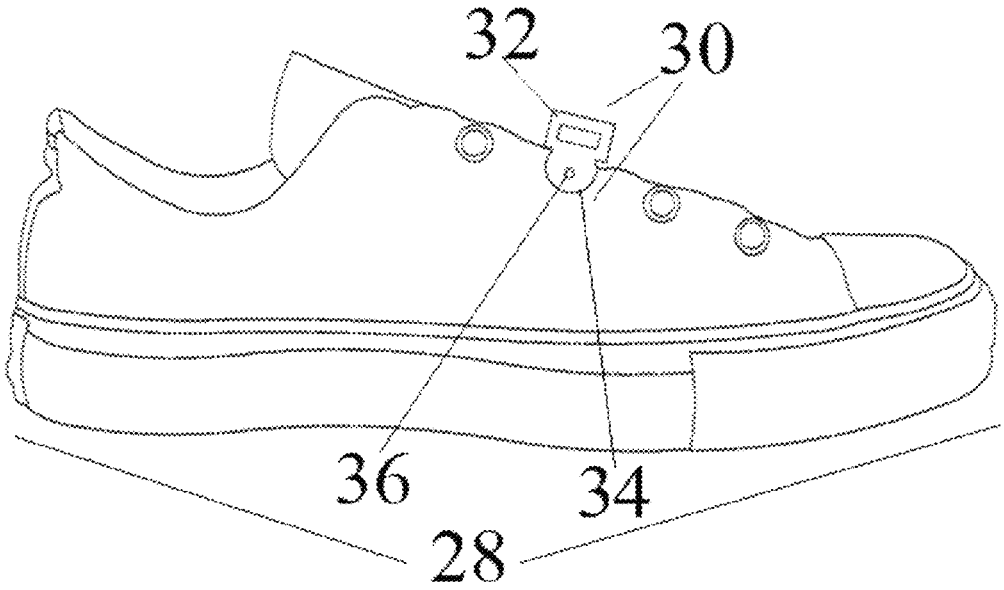
FIG. 5 shows an exemplary view of a shoe with the loop piece attached.

Referring now to the drawings, and in particular FIG. 1, there is shown an exemplary embodiment which describes among other things, a strap 10. The strap includes a hook and loop material on a first portion 12 of a side 14 and an engaging fabric material on a second portion 16 of a side 14. In the exemplary arrangement the hook and loop material comprises a releasable material such as Velcro® available from FASTENation, Inc in Clifton, N.J. However, in other embodiments other materials may be used.

The exemplary strap 10 also includes an enlarged first end 18 and a second end 20, whereby the second end is opposed of the first end. The first end 18 includes a first end aperture 22. The first end 18 is configured to be attached to a shoe by a fastener 26 extended through a shoelace aperture 24 of a shoe 28 and the first end aperture 22.

A loop piece 30 is also shown in FIG. 1. The exemplary loop piece 30 includes a loop 32. The loop 32 is configured to accept the second end of the strap 20 therein. The loop piece includes a tab portion 34. The tab portion 34 is in operative connection with the loop 32. The tab portion 34 includes a tab aperture 36. The tab portion 34 is configured to be attached to the shoe 28 by a further fastener 38 extended through a further shoelace aperture 40 and the tab aperture 36. The further shoelace aperture 40 is on an opposed side of the shoe from the aperture 24. The shoe 28 is enabled to be releasibly fastened in holding relation about a foot of a user by the second end of the strap 10 being extended through the loop 32 and the hook and loop material on the first portion of the side 12 being in engagement with the fabric material on the second portion of the side 16.

Figure 6:
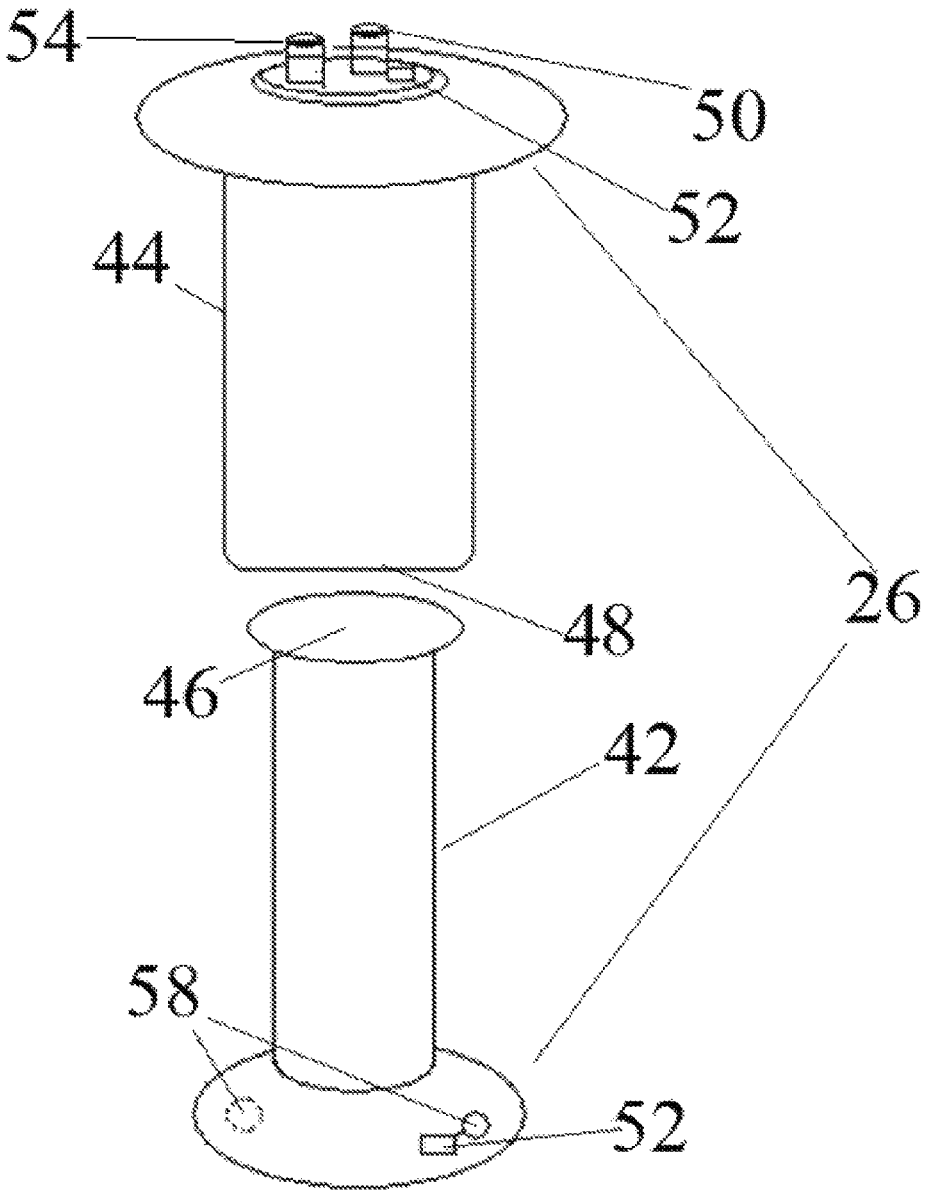
FIG. 6 shows an exemplary view of a fastener with an LED and associated circuitry.
Figure 7:
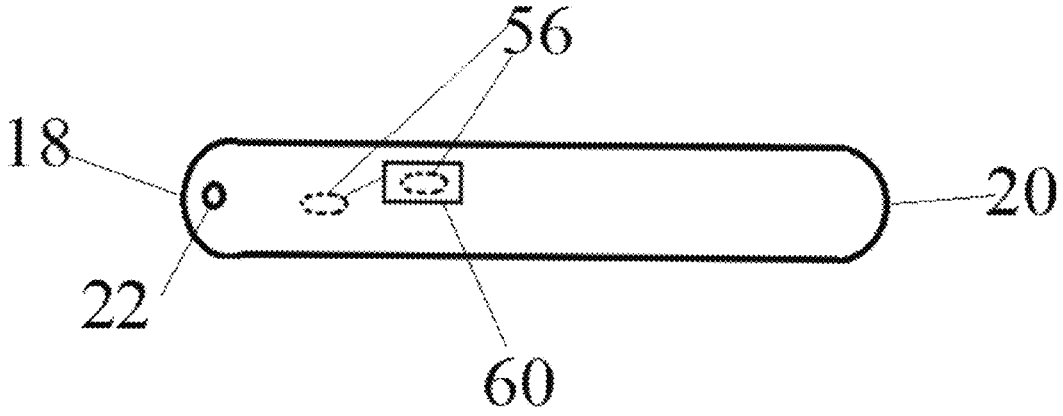
FIG. 7 shows an exemplary view of an embodiment of a strap with a sensor and circuitry.
Figure 8:
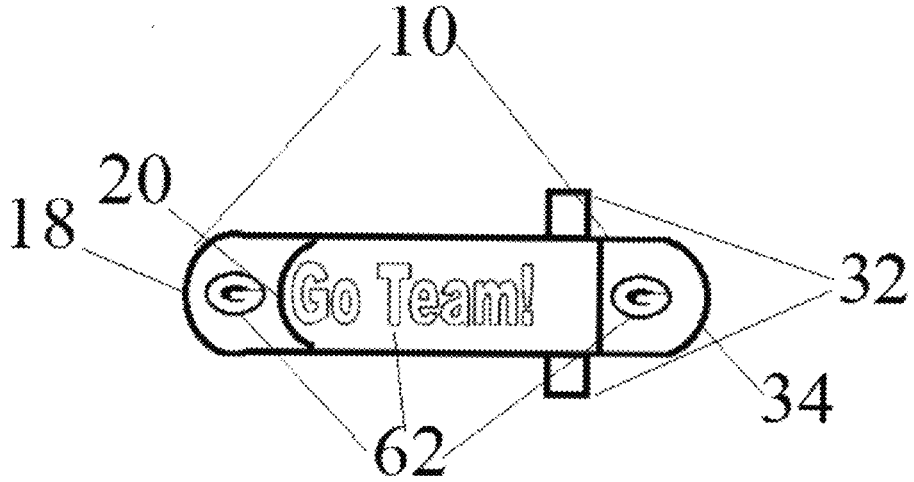
FIG. 8 shows an exemplary view of an embodiment of a closed strap with indicia.

In exemplary embodiments the fastener and further fastener may include fasteners such as, post hole screws, buttons, engageable snaps, inner-engaging connections, a snap base and a top, and fasteners having a base and top portion with inter-engaging projections and recesses, configured to be engaged while extending through the shoelace aperture and the tab or first end aperture, or any combination thereof. Referring now to FIG. 6, there is shown an exemplary embodiment which includes among other things, a fastener 26 and a base 42 and top portion 44 with inter-engaging projections 46 and recesses 48.

In an exemplary embodiment, the strap first portion including the hook and loop material is positioned adjacent the first end and therefore disposed away from the enlarged portion and the first end aperture. The second portion including the fabric material is adjacent the second end. However in other embodiments the positions of the hook and loop material and the fabric material on the side of the strap may be reversed. Alternatively in other arrangements the strap may be configured to have one of the hook and loop material on one lateral side of the strap while fabric extends on an opposed lateral side of the strap. Various approaches may be used depending on the loop and shoe configurations.

In an exemplary embodiment, a conversion kit further comprises at least one further strap and at least one further loop piece. The further strap and further loop piece may be of similar construction to the strap and loop pieces previously discussed. The further strap and loop piece are configured to be attached on opposed sides of the shoe through respective shoelace apertures.

In an exemplary embodiment, the components of the conversion kit are configured to be engaged with an existing shoe. The strap and loop piece are attached to shoelace apertures on opposed sides of the shoe. The further strap and further loop piece are configured to also be attached on opposed sides of the tongue of the shoe. To tighten the shoe so as to be in engagement with a user's foot, the second end of the strap is extended through the loop and the hook and loop material on the first portion is engaged with fabric material on the second portion. Likewise a second end of the further strap is extended through the further loop, and the hook and loop material on a further first portion is engaged with fabric material on the further second portion. In some exemplary arrangements, the strap and further strap may extend in parallel when engaged in holding relation. In other arrangements the strap and further strap may extend in a cross pattern.

In alternative arrangements only one strap and loop portion may be used to hold a shoe in engaged relation with a foot. In other exemplary embodiments more than two strap and loop pieces may be attached on each shoe.

In other exemplary embodiments the hook and loop material and the fabric material may be on opposed sides of the strap. The strap may be turned in the loop so that one lateral side engages the opposite lateral side of the strap. Alternatively in other embodiments the loop may comprise multiple loops that enable engaging the strap, while providing releasable engagement between the hook and loop and fabric material.

In an exemplary embodiment, the fastener and further fastener may include, light emitting diodes (LEDs) 50. These LEDs 50 may be single, or multi-colored. In such embodiments, the bodies of the fasteners, strap, or attached structures may include circuitry 52 which enables operation of the LEDs. Such circuitry may include a battery and one or more switches that enable the LEDs to be controlled and configured by the user. These controls may include the ability to turn the LEDs off and on, the ability to flash various patterns, and to control the color output, for example.

In other exemplary embodiments the fasteners may include sensors. These sensors may include, for example, sensors operative to detect properties that may be used to identify or calculate light, moisture, biological markers, pressure, temperature, heart rate, temperature, acceleration, velocity, and distance.

A light detector such as a photo sensor 54 may be included in a body of a fastener, or a photosensor 56 may be included on a strap or other structure. In exemplary embodiments, the photo sensor may be operative to sense a level of ambient light. Suitable circuitry 58, 60 in operative connection with the respective sensor 54, 56 may be operative when the level of ambient light falls below a certain level to cause LEDs or other light source to illuminate. Such a light source may be used to allow third parties to be aware of the person wearing the shoes in the dark. Alternatively, such a light source may project forward from the shoe to enable the wearer to see where they are going. Of course these approaches are exemplary and in other embodiments other approaches may be used.

In other embodiments, the fasteners, straps or other structures may include a sensor for detecting moisture. The moisture sensor may be in operative connection with suitable circuitry to detect moisture at certain levels. The circuitry may be usable to detect external moisture levels on the shoe. The circuitry may alternatively be configured to detect internal moisture within the shoes in the area of the feet which may be indicative of a health problem. The exemplary circuitry may be operative to transmit signals corresponding to this information by using a transmitter component of the circuitry. The transmitter may be operative to communicate wirelessly with a mobile device, wearable computer, or other computer which uses the signal data to determine the presence of certain conditions. Such determinations may result in the user being given human perceivable outputs such as audible or visible warnings. Alternatively or in addition such information may be stored for later analysis. Of course these approaches are exemplary and in other embodiments other approaches may be used.

In other exemplary embodiments, the fasteners, straps or other components may include a sensor for detecting biological markers. The biological marker sensor may be in operative connection with appropriate circuitry. The circuitry may be usable to detect certain compounds known to be released by different afflictions and diseases by the foot and leg. These afflictions may include certain markers for athlete's foot, or other fungal or bacterial infections. The circuitry may then transmit this information via signals by using a transmitter of the circuitry. The transmitter may communicate with a mobile device, wearable computer, or other computer which receives, analyzes and/or stores such information. Of course these approaches are exemplary and in other embodiments other approaches may be used.

In other embodiments, the fasteners, straps or other components may include a sensor for detecting acceleration. The acceleration sensor may be in operative connection with appropriate circuitry. The circuitry may be usable to detect current acceleration. This may include horizontal or vertical acceleration. Such acceleration may correspond to levels of shock that the user's foot experiences during running or other activity. The circuitry may wirelessly transmit this information via a signal by using a transmitter of the associated circuitry. The transmitter may communicate with a mobile device, wearable computer, or other computer. Such a computer may be operative to determine if a shock level is potentially damaging and give a user notice thereof. Alternatively or in addition the computer may be operative to calculate parameters such as running frequently or other values of interest. Such data may be stored or communicated to the user via appropriate outputs. Of course these approaches are exemplary and in other embodiments other approaches may be used.

In other embodiments, the fasteners, straps or other components may include a sensor for detecting parameters that correspond to velocity. The velocity sensor may be in operative connection with appropriate circuitry. The circuitry may provide data usable to make a determination of current velocity which can be useful for runners attempting to keep a pace. The circuitry may wirelessly communicate using a transmitter of the circuitry. The transmitter may communicate with a mobile device, wearable computer, or other computer. Such a computer may use the sensed data directly or in combination with other data such as GPS data to make velocity determinations or to resolve other data that can be communicated to a user. Of course these approaches are exemplary and in other embodiments other approaches may be used.

In other exemplary embodiments, the fasteners, loop pieces or other related components may include a sensor for detecting parameters that correspond to distance. The distance sensor may be in operative connection with appropriate circuitry. The circuitry may be usable to detect one or more parameters which correspond to distance which can be useful for runners or other persons attempting to track their distance moved, or by other individuals to keep track of exercise. The circuitry may then communicate this information via wireless signals by using a transmitter. The transmitter may communicate with a mobile device, wearable computer, or other computer. The computer may be operative to make the distance determination based on one or more parameters and other data such as GPS data. Of course these approaches are exemplary and in other embodiments other approaches may be used.

In other embodiments, the fasteners, loop pieces or other related structures may include a sensor for detecting heart rate. The heart rate sensor may be in operative connection with appropriate circuitry. The circuitry may be usable to detect pressure or electrical parameters that correspond to heart rate, blood pressure, or other parameters of those exercising, or the heart rate of at risk individuals. The circuitry may then transmit this information via wireless signals by using a transmitter. The transmitter may communicate with a mobile device, wearable computer, or other computer. The computer may be operatively programmed to provide outputs to a user and/or to record such information. Of course these approaches are exemplary and in other embodiments other approaches may be used.

In other embodiments, the bodies of the fasteners, loop pieces or other related components may include a sensor for detecting temperature. The temperature sensor may be in operative connection with appropriate circuitry. The circuitry may be usable to detect external air temperature adjacent the shoe. The sensor and circuitry may alternatively be usable to detect internal temperature within the shoes in the area of the feet which may be indicative of a health problem if elevated or below normal. The circuitry may operate to wirelessly transmit this information by using a transmitter. The transmitter may communicate with a mobile device, wearable computer, or other computer. Such a computer may be programmed to make determinations and/or to communicate information to a wearer. Such determinations and messages may include, for example, information that the air temperature is below freezing and ice formation may occur. Other warnings may include a foot temperature that has a risk of hypothermia or frostbite. Other determinations may warn of high temperature such as fever or risk of burns, for example. Of course these approaches are exemplary and in other embodiments other approaches may be used.

In some exemplary embodiments, the fastener loop pieces may include customizable indicia 62, including, but not limited to, engraving, colors, logos, letters, symbols and initials. Straps or fasteners may include different colors, insignias, letters, words or other suitable indicia as selected by the user. This may enable the user to select color coordinated fasteners and straps. Colors may correspond to a user's selected school or team colors, for example. Exemplary insignias may include mascots, cartoon character flags, crests or other designs. Indicia may also include, for example, initials, names, sayings or slogans. The capabilities of exemplary embodiments to change the straps and fasteners on a shoe may provide the user with the capabilities to readily customize their shoes in different selected ways. Further exemplary embodiments may enable a user to selectively skip shoelace holes with laces to enable attachment of the strap and loop pieces while still enabling use of the laces as well. Of course these approaches are exemplary.

In an alternative exemplary embodiment, the strap further comprises an underside. The underside is configured to be below the first portion of the side and the second portion of the side. The underside includes a pressure sensor. The pressure sensor may be configured to a variable capacitor including a substrate within a plurality of channels. The variable capacitor has elements being movable within the plurality of channels with changes of pressure on the underside of the strap. An inductor electrically connected to the variable capacitor, an electrical circuit including the variable capacitor and the inductor being configured to generate are response to a change of pressure on the underside of the strap. This response may be an electronic signal configured to be transmitted to a mobile device, a wearable computer, or other computer. The pressure sensor located in the underside of the strap may allow individuals to determine if the shoes wearer has shown a severe uptick in swelling or fluid in the feet. This fluid increase may allow the computer to make a determination of an early sign of heart failure before an individual may notice. The computer may provide outputs or other indications to the user of such conditions.

In an exemplary embodiment, the strap and loop piece and optionally at least one further strap and further loop piece may be configured to display on an additional side, indicia of symbols of personalization. The additional side is opposite the side which includes hook and loop material on a first portion of the side and an engageable fabric material on a portion of the second side. These symbols may include, but not limited to logos, colors, letters, words, trademarks, service marks, patterns, textures, and initials, as previously discussed. Alternatively such pieces may include wearable displays which are operative to output changeable colors or indicia.

In an alternative exemplary embodiment a fastening system may be configured to be used with a shoe. The shoe includes a plurality of holes also referred to herein as lace apertures configured to accept a lace. The holes are disposed on opposed sides of a tongue of such shoe. In this alternative arrangement a first piece is configured to be attached to the shoe by operatively engaging at least one aperture on a first side of the tongue of the shoe. A second piece is provided. The second piece is configured to be attached to the shoe by operatively engaging at least one aperture on a second side of the tongue, opposite the first side. The first piece and the second piece are holdable in releasable engagement by engagement of hook and loop material with a hook and loop engaging fabric. Such an alternative arrangement may hold the shoe without the use of a loop.

A further embodiment provides components operative to change a shoe from laced to strap holding engagement. The components include at least one first piece. The at least one first piece includes a strap accepting loop. The at least one first piece also includes an aperture or projection in operative connection with the loop. The aperture or projection is configured to be held in operative attached engagement with a shoelace hole on a first side of a tongue of a shoe. The components also include at least one second piece. Each second piece includes a strap portion. The strap portion is configured to be accepted in the loop. The components also include a further aperture or projection in operative connection with the strap portion. The further aperture or projection is configured to be held in operative attached engagement with a further shoelace hole on a second side of the tongue opposed to the first side.

Thus the example embodiments and arrangements achieve improved capabilities, eliminate difficulties encountered in the use of prior methods and systems, and attain the desirable results described herein.

In the foregoing description, certain terms have been used for brevity, clarity and understanding. However, no unnecessary limitations are to be implied therefrom because such terms are used for descriptive purposes and are intended to be broadly construed.

Moreover the descriptions and illustrations herein are by way of examples and the invention is not limited to the features shown and described.

Further, it should be understood that features and/or relationships associated with one embodiment can be combined with features and/or relationships from other embodiments. That is, various features and/or relationships from various embodiments can be combined in further embodiments. The inventive scope of the disclosure is not limited to only the embodiments shown or described herein.

Having described the features, discoveries and principles of the exemplary embodiments, the manner in which they are utilized and carried out, and the advantages and useful results attained, the new and useful arrangements, combinations, methodologies, structures, devices, elements, combinations, operations, processes and relationships are set forth in the appended claims.

I claim:

1. Apparatus comprising:

a conversion kit for changing a shoe between lace and strap holding construction, including:

a strap, wherein the strap includes a side, wherein the side includes hook and loop material on a first portion of the side and an engageable fabric material on a second portion of the side, wherein the strap includes a first end and a second end, whereby the second end is opposed of the first end, wherein the first end includes a first end aperture, wherein the first end is configured to be attached to a shoe by a fastener extended through a shoelace aperture of the shoe and the first end aperture, wherein the strap further comprises an underside, wherein the underside is configured to be below the side, a loop piece, wherein the loop piece includes a loop, wherein the loop is configured to accept the second end of the strap therein, a tab portion, wherein the tab portion is in operative connection with the loop, wherein the tab portion includes a tab aperture, wherein the tab portion is configured to be attached to the shoe by a further fastener extended through the tab aperture and a further shoelace aperture, wherein the further shoelace aperture is on an opposed side of the shoe from the aperture, wherein the shoe is enabled to be releasably fastened by the strap being extended through the loop and the hook and loop material on the first portion being in engagement with the fabric material on the second portion, wherein the underside includes a pressure sensor, wherein the pressure sensor comprises a variable capacitor including a substrate within a plurality of channels, wherein the variable capacitor includes elements that are movable within the plurality of channels with changes of pressure on the underside of the strap, an inductor electrically connected to the variable capacitor, an electrical circuit including the variable capacitor and the inductor being configured to generate a response to a change of pressure on the underside of the strap.

2. The apparatus of claim 1, wherein the conversion kit comprises at least two straps and at least two loop pieces, wherein the each respective strap and each respective loop piece are configured to be attached on opposed sides of the shoe through respective shoelace apertures.

3. The apparatus of claim 2, wherein each strap and each loop piece are configured to be releasably fastened with the second end of the respective strap extended through one respective loop and the hook and loop material on the first portion of the respective strap being in engagement with fabric material on the second portion such that the straps are arranged in a cross pattern.

4. The apparatus of claim 2, wherein each strap and each loop are configured to be releasably fastened with the second end of the respective strap extended through one respective loop and the hook and loop material on the first portion of the respective strap being in engagement with fabric material on the second portion such that the straps are arranged in a parallel pattern.

5. The apparatus of claim 1, wherein at least one of the strap and loop piece is attachable to a shoe which has a shoelace through a plurality of shoelace apertures.

6. The apparatus of claim 1, and further comprising the fastener and the further fastener wherein at least one of the fastener and the further fastener include at least one of;

post hole screws, buttons, engageable snaps, inner-engaging connections, snap base and a top, and fasteners having a base and top portion with inter-engaging projections and recesses, configured to be engaged while extending through the respective shoelace aperture and the respective tab or first end aperture, or any combination thereof.

7. The apparatus of claim 6, wherein at least one of the fastener and the further fastener comprise customizable visible indicia, including, but not limited to, engraving, colors, logos, letters, symbols and initials.

8. The apparatus of claim 7, wherein at least one of the at least one fastener and further fastener includes a body having a recess configured for receipt of an engaging projection to secure the strap and loop piece.

9. The apparatus of claim 7, wherein at least one of the at least one strap and the at least one loop piece include on a further side, opposed of the side, visible indicia including at least one of a logo, color, letter, word, trademark, service mark, pattern and texture.

10. The apparatus of claim 1, and further comprising:

the fastener and the further fastener, wherein the at least one of the fastener and the further fastener comprise customizable visible indicia, including, at least one of, engraving, colors, logos, letters, symbols and initials.

11. The apparatus of claim 1, and further comprising:

the fastener and the further fastener, wherein at least one of the fastener and the further fastener include at least one light emitting diode.

12. The apparatus of claim 11, wherein the at least one light emitting diode comprises a single color light emitting diode.

13. The apparatus of claim 11, wherein the at least one light emitting diode comprises a multi-colored light emitting diode.

14. The apparatus of claim 13, wherein at least one output of at least one of the light emitting diodes is user configurable.

15. The apparatus of claim 14, wherein at least one output of the at least one light emitting diode is output responsive at least in part to a sensor on the shoe.

* * * * *